US010950942B2

(12) United States Patent
Xu et al.

(10) Patent No.: US 10,950,942 B2
(45) Date of Patent: Mar. 16, 2021

(54) GROUND PLANE INDEPENDENT ANTENNA

(71) Applicant: Smarteq Wireless Aktiebolag, Kista (SE)

(72) Inventors: Yuan Xu, Sollentuna (SE); Johan Sjöberg, Sollentuna (SE); Mattias Hellgren, Åkersberga (SE)

(73) Assignee: SMARTEQ WIRELESS AKTIEBOLAG

( * ) Notice: Subject to any disclaimer, the term of this patent is extended or adjusted under 35 U.S.C. 154(b) by 106 days.

(21) Appl. No.: 16/174,465

(22) Filed: Oct. 30, 2018

(65) Prior Publication Data

US 2019/0131709 A1 May 2, 2019

(30) Foreign Application Priority Data

Oct. 30, 2017 (SE) ..... 1751340-9

(51) Int. Cl.

| | |
|---|---|
| ***H01Q 1/24*** | (2006.01) |
| ***H01Q 9/04*** | (2006.01) |
| ***H01Q 1/42*** | (2006.01) |
| ***H01Q 1/36*** | (2006.01) |
| ***H01Q 1/48*** | (2006.01) |

(52) U.S. Cl.

CPC ..... *H01Q 9/0421* (2013.01); *H01Q 1/243* (2013.01); *H01Q 1/36* (2013.01); *H01Q 1/42* (2013.01); *H01Q 1/48* (2013.01); *H01Q 9/0442* (2013.01)

(58) Field of Classification Search

CPC ..... H01Q 1/243; H01Q 1/48; H01Q 9/0421; H01Q 9/0442; H01Q 13/10

See application file for complete search history.

(56) References Cited

U.S. PATENT DOCUMENTS

| | | | | |
|---|---|---|---|---|
| 6,985,108 | B2 * | 1/2006 | Mikkola | H01Q 1/243 343/700 MS |
| 7,932,863 | B2 | 4/2011 | Pros et al. | |
| 8,350,761 | B2 * | 1/2013 | Hill | H01Q 5/40 343/702 |
| 2002/0126052 | A1 * | 9/2002 | Boyle | H01Q 9/0442 343/702 |

(Continued)

FOREIGN PATENT DOCUMENTS

| | | | |
|---|---|---|---|
| WO | 03096475 | A1 | 11/2003 |
| WO | 2010010529 | A2 | 1/2010 |

OTHER PUBLICATIONS

Swedish Search Report, App. No. 1751340-9, dated May 29, 2018; pp. 1-4; Swedish Patent and Registration Office, Stockholm, Sweden, Rune Bengtsson.

*Primary Examiner* — Hasan Z Islam

(74) *Attorney, Agent, or Firm* — Burr & Forman LLP; Jeffrey H. Kamenetsky

(57) ABSTRACT

Multiband low profile antenna arrangement comprising an antenna element and a ground plane, where said antenna element has one feed pin and at least one ground pin, and where said ground pin is connected to said ground plane, characterised in, that said feed pin and said at least one ground pin are positioned on the same side of a slot in said ground plane, that said ground plane is positioned at a predefined distance from any mounting surface, and that said slot is designed to compensate for any capacitive or inductive connection between said ground plane and a possible external ground plane on said mounting surface.

5 Claims, 2 Drawing Sheets

(56) References Cited

U.S. PATENT DOCUMENTS

| | | | | |
|---|---|---|---|---|
| 2003/0193437 | A1* | 10/2003 | Kangasvieri | H01Q 1/243 343/702 |
| 2004/0125029 | A1* | 7/2004 | Maoz | H01Q 13/106 343/702 |
| 2008/0055164 | A1* | 3/2008 | Zhang | H01Q 1/243 343/702 |
| 2008/0231521 | A1* | 9/2008 | Anguera Pros | H01Q 9/0421 343/702 |
| 2009/0273535 | A1* | 11/2009 | Lee | H01Q 1/48 343/848 |
| 2013/0141298 | A1 | 6/2013 | Zhang | |
| 2018/0069306 | A1* | 3/2018 | Xue | H01Q 1/44 |

* cited by examiner

GROUND PLANE INDEPENDENT ANTENNA

TECHNICAL FIELD

The present disclosure relates to a multiband low profile antenna arrangement comprising an antenna element and a ground plane, where the antenna element has one feed pin and at least one ground pin, and where the ground pin is connected to the ground plane.

PRIOR ART

A conventional low profile antenna in the category of multiband low profile antenna arrangements is a typical inverted-F antenna (IFA) or a planar inverted-F antenna (PIFA) or patch antenna with a printed circuit board (PCB) ground plane sealed in a mechanic, usually a plastic enclosure. Because of its small size, it can be easily affected by surrounding components. For instance, once it is mounted on a large metallic surface, such as a metal cabinet, antenna performance can be degraded.

The antenna can be made for mounting on a mounting surface made out of a non-conductive material, where the antenna arrangement and its internal ground plane is optimized to function in such conditions. It is also possible to optimize the design of the antenna arrangement and its internal ground plane to be mounted on a surface made out of a conductive material, where the antenna arrangement is designed to take advantage of the conductive mounting surface and its function as an external ground plane.

Low profile ground dependent conventional antenna arrangements have limited flexibility when installation or application varies with regards to the material of the mounting surface. It is known to minimize the impact of an external large ground plane, for example by creating features on the intern ground plane to enable a galvanic contact to an external ground plane, where it is a problem to ensure a good contact with the external ground plane.

It is also known to increase the size of the antenna ground plane and/or the distance between the antenna ground plane and any external ground plane, to minimize any impact of an external ground plane on the antenna arrangement.

Patent publication U.S. Pat. No. 7,932,863 B2 relates to an antenna structure with a ground plane and an antenna element where the ground plane has one or several open slots. The feeding and ground connections of the antenna structure are placed at the two different sides of the slot. The slot is used to create additional resonances and thereby increase the bandwidth of the antenna.

SUMMARY

In different applications, such as the Internet of things (IoT), it is a technical problem to provide an antenna arrangement that is small in size, that is protected from environmental factors, and that can be positioned at different mounting surfaces where the function and efficiency of the antenna arrangement is independent of the presence of a possible external ground plane.

The objective of the present disclosure is to minimize the impact of an external ground plane in a small, compact, low profile antenna arrangement.

It is desired to provide an antenna arrangement with the following characteristics:

- Multi functionality, i.e. a broadband antenna to cover 2G/3G/4G LTE cellular band (698-960 MHz, 1710-2690 MHz).
- Low profile, compact size.
- Robustness: High IP-class, sealed in plastic enclosure for tough environment.

- High performance such as high efficiency, high gain and omni-directional in azimuth plane.
- Reliable form factor for easy installation.

The requirements of small size, robustness and multi functionality are hard to meet together with requirements of the possibility to mount the antenna arrangement on any mounting surface regardless of if the mounting surface will function as an external ground plane.

The antenna arrangement can be optimised to function together with an external ground plane or without any connection to an external ground plane, however, it is a technical problem to provide a ground plane independent antenna arrangement with a low profile and compact size that will have the same performance regardless of a possible external ground plane.

With the purpose of solving one or several of the above problems, and on the basis of prior art such as it has been shown above and the indicated technical field, the present disclosure teaches that the feed pin and the at least one ground pin are positioned on the same side of a slot in the ground plane, that the ground plane is positioned at a predefined distance from any mounting surface, and that the slot is designed to compensate for any capacitive or inductive connection between the ground plane and a possible external ground plane on the mounting surface.

It is proposed that the total slot length of the slot is equal to, or longer than, $\lambda_{peak}/8$, where $\lambda_{peak}$ is a wavelength corresponding to a frequency generated by a capacitive or inductive connection between the ground plane and a large external ground plane at the predefined distance from the ground plane.

The present disclosure teaches

- that the slot is positioned with an angle into the ground plane that allows the required length of the slot, and/or
- that the slot is given a zic-zac shape, or any other shape, that provides the required length of the slot, and/or
- that two or more slots are used with a combined total length of at least $\lambda_{peak}/8$, in order to achieve the total slot length of at least $\lambda_{peak}/8$.

With the purpose of providing a low profile antenna arrangement with a compact size, it is proposed that the predefined distance is equal to, or shorter than, 10 mm, such as equal to, or shorter than, 5 mm.

It is proposed that the antenna arrangement comprises a PCB, and that the ground plane is a conductive layer in the PCB.

Used antenna element may be in the form of an inverted-F antenna (IFA) or a planar inverted-F antenna (PIFA).

With the purpose of providing a compact size it is proposed that the ground plane has an elongated shape, and that the slot, the feed pin and the at least one ground pin are positioned on one and the same half of the elongated shape of the ground plane.

If a wavelength, $\lambda$, corresponds to the lowest frequency band of the multi band antenna arrangement, it is proposed that the width of the ground plane can be smaller than $\lambda/8$, and that the length of the ground plane can be smaller than $3\lambda/8$. On such ground plate it is proposed that the height of the antenna element can be $\lambda/10$, that the length of the antenna element can be $\lambda/5$ and that the width of the antenna element can be $\lambda/20$.

It is proposed that several slots can be used in order to compensate for several resonances in different frequencies, where each slot will compensate for one frequency. As an example, a first slot can be adapted to compensate for a resonance in a first frequency where the first slot length is equal to, or longer than, $\lambda_{peak}/8$ of that first frequency, and a second slot can be adapted to compensate for a second resonance in a second frequency where the second slot length is equal to, or longer than, $\lambda_{peak}/8$ of that second frequency.

The antenna element is designed to cover at least two bands, which means that the slot can be designed to provide its compensation for the lower of the at least two bands, or several slots can be used to provide compensation in both the lower band and in the higher band. One possible embodiment is that the antenna element is designed to cover a lower band of 698 to 960 MHz, and a higher band of 1 710 to 2 690 MHz, in which case a single slot would be designed to compensate for any frequency generated by a capacitive or inductive connection between the ground plane and a large external ground plane at the predefined distance from the ground plane in the range of 698 to 960 MHz, or two slots can be used where a first slot is designed to compensate for a first frequency generated by a capacitive or inductive connection between the ground plane and a large external ground plane at the predefined distance from the ground plane in the range of 698 to 960 MHz, and a second slot is designed to compensate for a second frequency generated by a capacitive or inductive connection between the ground plane and a large external ground plane at the predefined distance from the ground plane in the lower range of 698 to 960 MHz or in the higher range of 1 710 to 2 690 MHz.

It is proposed that a feeding line belonging to the antenna arrangement is positioned on the opposite side of the ground plane from said antenna element, and that the feeding line is led through the ground plane at the position of the feed pin, where it is connected to the feed pin.

With the purpose of providing a robust antenna arrangement with a reliable form factor, it is proposed that the antenna arrangement comprises a low profile casing, which encloses the ground plane and the antenna element, and provides the predefined distance between the ground plane and the mounting surface, where the casing is made out of a polymer non-conductive material.

The advantages that foremost may be associated with a multiband low profile antenna arrangement according to the present disclosure are that it provides a ground plane independent antenna arrangement with a low profile and compact size that will have the same performance regardless of a possible external ground plane.

In different IoT applications, antenna arrangements will be required in many different locations where it is desired to have a robust, small, compact, low profile antenna arrangement that can be easily set up in any kind of environment. The present disclosure provides an antenna arrangement that can be used and set up on any mounting surface where a possible external ground plane on the mounting surface will have no detrimental effect on the performance of the antenna arrangement.

BRIEF DESCRIPTION OF THE DRAWINGS

A multiband low profile antenna arrangement according to the present disclosure will now be described in detail with reference to the accompanying drawings, in which.

DETAILED DESCRIPTION OF PREFERRED EMBODIMENTS

Figure 1:
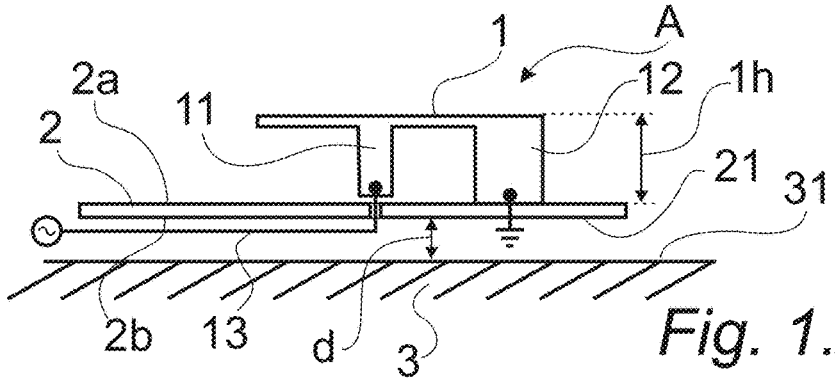
FIG. 1 shows a simplified and schematic side view of an antenna arrangement according to the present disclosure.

In the following, the present disclosure will be described with a reference to FIG. 1 showing a multiband low profile antenna arrangement A comprising an antenna element 1 and here illustrated with a PCB 2 to which the antenna element 1 is mounted. One conductive surface belonging to the PCB 2 function as a ground plane 21. The antenna element 1 has one feed pin 11 and at least one ground pin 12, where the ground pin 12 is connected to the ground plane 21.

Figure 2:
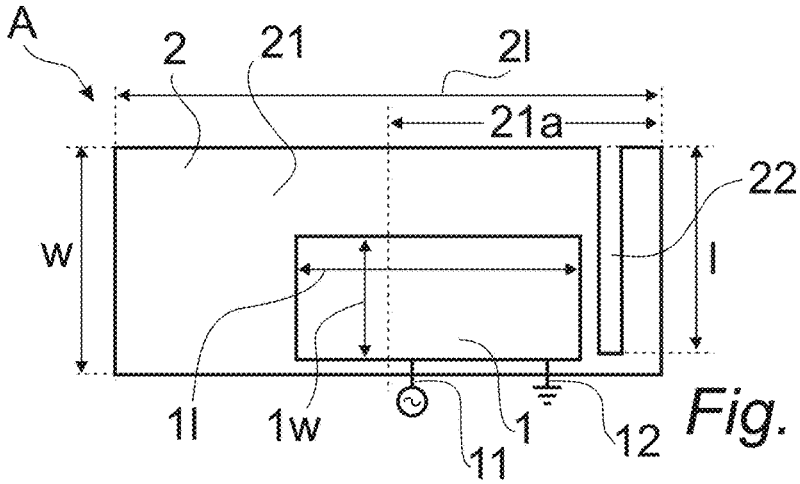
FIG. 2 shows a simplified and schematic top view of an antenna arrangement according to the present disclosure.

FIG. 2 shows a top view of the antenna arrangement A with the antenna element 1, the PCB 2 and the ground plane 21. The feed pin 11 and the at least one ground pin 12 cannot be seen in the view of FIG. 2, hence the positions for the feed pin 11 and the at least one ground pin 12 are only indicated with the symbols for the feed signal and ground. Here it can be seen that the feed pin 11 and the at least one ground pin 12 are positioned on the same side of a slot 22 in the ground plane 21.

With renewed reference to FIG. 1, it can be seen that the ground plane 21 is positioned at a predefined distance d from any mounting surface 3. The slot 22 is designed to compensate for any capacitive or inductive connection between the ground plane 21 and a possible external ground plane 31 on the mounting surface 3.

Figure 3A:
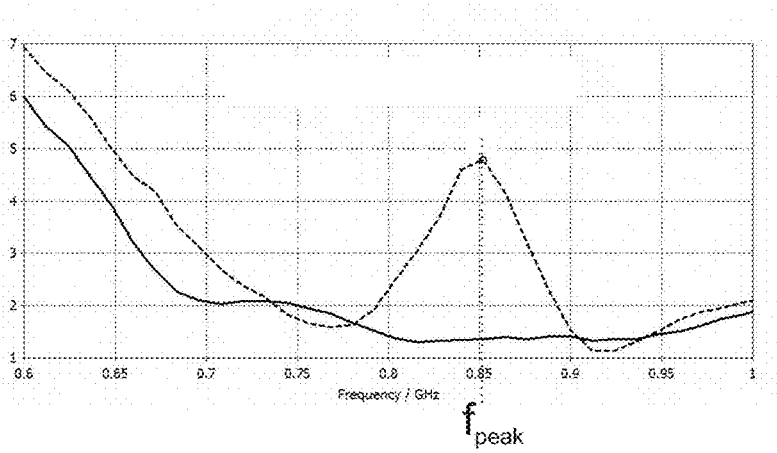
FIG. 3*a* is a graph showing the voltage standing wave ration (VSWR) of a conventional antenna arrangement with and without the effect of an external ground plane.
Figure 4A:
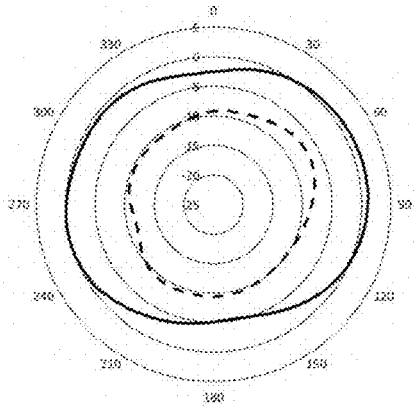
FIG. 4*a* is a graph showing the radiation pattern in the azimuth plane of a conventional antenna arrangement with and without the effect of an external ground plane.

FIG. 3*a* is a graph showing the voltage standing wave ration (VSWR) of a conventional antenna arrangement focusing on the lower frequency band, and FIG. 4*a* is a graph showing the radiation pattern in the azimuth plane of a conventional antenna. The full line in both FIGS. 3*a* and 4*a* represents the result from a conventional antenna arrangement on a plastic mounting surface 3. The dotted line both FIGS. 3*a* and 4*a* represents the result from a conventional antenna arrangement on a metallic mounting surface 3, where the metallic mounting surface will function as an external ground plane 31. It is clear from the graph that the external ground plane 31 has a detrimental effect on the characteristics of the antenna arrangement, as can be seen from the peak at the frequency $f_{peak}$ in FIG. 3*a* and the limited signal strength in the radiation pattern in FIG. 4*a*.

The purpose of the present disclosure is to minimize, or totally compensate for, the detrimental effect of the external ground plane at the frequency $f_{peak}$.

It is proposed that the total slot length I of the slot 22 is equal to, or longer than, $\lambda_{peak}/8$, meaning $$I \geq \lambda_{peak}/8$$

where $\lambda_{peak}$ is a wavelength corresponding to $f_{peak}$ the frequency generated by a peak, capacitive or inductive connection between the ground plane 21 and a large external ground plane 31 at the predefined distance d from the ground plane 21.

The antenna arrangement is designed according to specification and the frequency $f_{peak}$ is measured for the specific design of the antenna element. Measured $f_{peak}$ correspond to a $\lambda_{peak}$ which in turn will decide required length I of the slot 22.

Figure 3B:
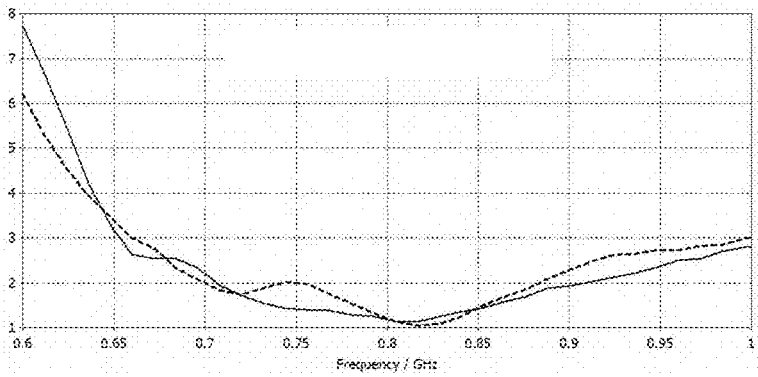
FIG. 3*b* is a graph showing the VSWR of an antenna arrangement according to the present disclosure with and without the effect of an external ground plane.
Figure 4B:
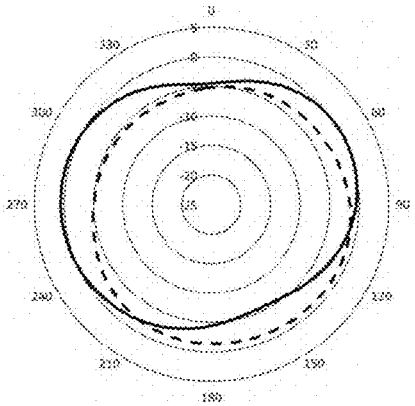
FIG. 4*b* is a graph showing the radiation pattern in the azimuth plane of an antenna arrangement according to the present disclosure with and without the effect of an external ground plane.

FIG. 3*b* is a graph showing the voltage standing wave ration (VSWR) of an antenna arrangement according to the present disclosure focusing on the lower frequency band, and FIG. 4*b* is a graph showing the radiation pattern in the azimuth plane of an antenna arrangement according to the present disclosure. The full line in both FIG. 3*b* and FIG. 4*b* represents the result from an inventive antenna arrangement on a plastic mounting surface 3. The dotted line in both FIG. 3*b* and FIG. 4*b* represents the result from an inventive antenna arrangement on a metallic mounting surface 3. It is clear that the inventive design has compensated for the detrimental effect of the external ground plane 31 since there is no sign of the peak at the frequency $f_{peak}$ that is so clear in FIG. 3*a*, and since the signal strength in the radiation pattern in FIG. 4*b* is not limited as it is with the conventional antenna arrangement according to FIG. 4*a*.

Figure 5A:
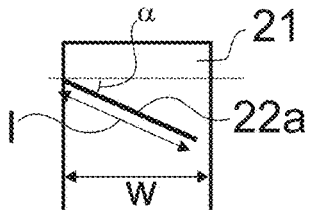
FIG. 5*a* is a simplified and schematic illustration of a first proposed embodiment of how to provide a longer slot.
Figure 5B:
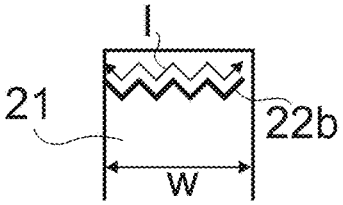
FIG. 5*b* is a simplified and schematic illustration of a second proposed embodiment of how to provide a longer slot.
Figure 5C:
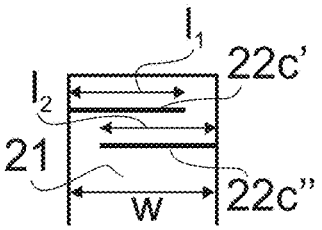
FIG. 5*c* is a simplified and schematic illustration of a third proposed embodiment of how to provide a longer slot.

The desired length I can be achieved in different ways. FIG. 2 shows a slot 22 where the slot length I is shorter than the width w of the ground plane 21. However, due to design the width 22 might be too small to accommodate a slot with required length I. FIGS. 5*a*, 5*b* and 5*c* illustrates different ways of achieving required slot length I in relation to available width w on the ground plane 21.

FIG. 5*a* shows a proposed embodiment where the slot 22*a* is positioned with an angle α into the ground plane 21 that provides the required length I of the slot 22*a* that is longer than the width w of the ground plane 21.

FIG. 5*b* shows a proposed embodiment where the slot 22*b* is given a zic-zac shape that provides the required length I of the slot 22*b*. It should be understood that any kind of shape can be used to provide the desired slot length I that is longer than the width w of the ground plane 21, where the zic-zac shape is one example of such shape.

FIG. 5*c* shows a proposed embodiment where two or more slots 22*c*', 22*c*" with a first length $l_1$ and a second length $l_2$ are used to provide the desired slot length l that is longer than the width w of the ground plane 21.

The skilled person understand that any combination of the above proposed embodiments illustrated in FIGS. 5*a*, 5*b* and 5*c* can be used in order to provide the total slot length l of at least $\lambda_{peak}/8$. It should also be understood that even if these embodiments can be used to provide a slot length l that is longer than the width w of the ground plane 21, these embodiments can also be used if the slot length is shorter than the width w of the ground plane 21.

The capacitive and inductive connection between the ground plane 21 and a possible external ground plane 31 depends on many different parameters, but the connection decreases with the predefined distance d between the ground plane 21 and an external ground plane 31. The present disclosure allows a relatively short distance d, and hence a low physical height of the antenna arrangement, while still maintaining a low impact on antenna performance from an external ground plane 31. It is proposed that the predefined distance d can be equal to, or shorter than 10 mm, and preferably equal to or shorter than 5 mm.

As shown before, the antenna arrangement A may comprise a PCB 2, where the ground plane 21 is a conductive layer in the PCB 2. If the PCB 2 is a multi-layer PCB, then all layers have to be slotted so that the slot 22 will have the intended effect.

The antenna element 1 may be in the form of an IFA or a PIFA.

As illustrated in FIG. 2, it is proposed that the ground plane 21 has an elongated shape, and that the slot 22, feed pin 11 and at least one ground pin 12 are positioned on one and the same half 21*a* of the elongated shape of the ground plane 21.

There are many ways of designing an antenna element, and one possible embodiment of the present disclosure will now be presented. In a multi band antenna arrangement it is the lowest frequency band, or the band with the longest wavelengths, that dictates the smallest physical size of the components of the antenna element. If a wavelength λ corresponds to the lowest frequency band of the multi band antenna arrangement A, then it is proposed that the width w of the ground plane 21 is equal to or smaller than λ/8, and that the length 21 of the ground plane 21 is equal to or smaller than 3λ/8.

It is also proposed that the height 1*h* of the antenna element 1 is λ/10, that the length 1*l* of the antenna element 1 is λ/5 and that the width 1*w* of the antenna element 1 is λ/20.

Where the antenna element 1 is designed to cover at least two bands it is in the lowest frequency band, or in the band with the longest wavelengths, that a capacitive or an inductive connection with a possible external ground plane 3 will appear, hence the present disclosure teaches that the slot 22 is designed to provide the compensation for the lower of the at least two bands.

It should be understood that it is possible to use several slots, not only to elongate one slot, but also in order to compensate for several resonances in different frequencies, where each slot will compensate for one frequency. As an example, it is possible to use the embodiment presented in FIG. 5*c* to compensate for a resonance in a first frequency where the first slot length $l_l$ is equal to, or longer than, $\lambda_{peak}/8$ of that first frequency, and to compensate for a second resonance in a second frequency where the second slot length $l_2$ is equal to, or longer than, $\lambda_{peak}/8$ of that second frequency.

As an exemplifying example, it is proposed that the antenna element 1 is designed to cover a lower band of 698 to 960 MHz, and a higher band of 1 710 to 2 690 MHz. In this example the slot 22 is designed to compensate for any frequency generated by a capacitive or inductive connection between the ground plane 21 and a large external ground plane 31 at the predefined distance d from the ground plane 21 in the range of 698 to 960 MHz.

FIG. 3*a* shows that with a conventional design, a peak frequency $f_{peak}$ appears at 850 MHz when the antenna element is positioned on a metallic mounting surface functioning as an external ground plane. FIG. 3*b* shows that a design according to the present disclosure where a slot with required length is used provides a ground plane independent antenna arrangement.

With renewed reference to FIG. 1, where it is shown that the antenna element 1 is positioned on one side 2*a* of the ground plane 21, and it is proposed that a feeding line 13, belonging to the antenna arrangement A, is positioned on the opposite side 2*b* of the ground plane 21 from the antenna element 1, and that the feeding line 13 is led through the ground plane 21 at the position of the feed pin 11 and connected to the feed pin 11, where the feed pin 11 or feeding line 13 have no galvanic contact with the ground plane 21.

Figure 6:
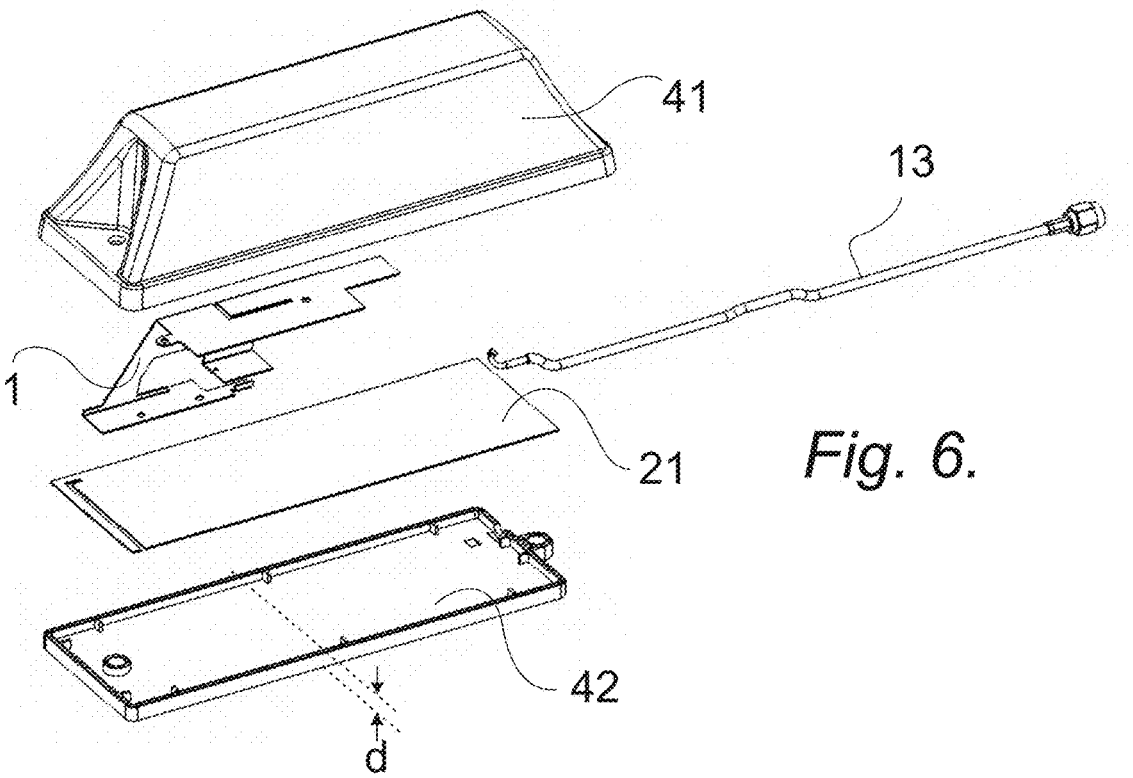
FIG. 6 is an exploded view of an inventive antenna arrangement with a casing.

It is proposed that the antenna arrangement comprises a low profile casing. FIG. 6 shows an exploded view of an inventive antenna arrangement A including the casing, comprising a top part 41 and a bottom part 42.

It is proposed that the casing 41, 42 encloses the ground plane 21 and antenna element 1, that the casing provides the predefined distance d between the ground plane 21 and the mounting surface 3, and that the casing is made out of a polymer non-conductive material.

It will be understood that the present disclosure is not restricted to the afore-described and illustrated exemplifying embodiments thereof and that modifications can be made within the scope of the present disclosure as defined by the accompanying Claims.

The invention claimed is:

1. A multiband low profile antenna arrangement comprising:

an antenna element and a ground plane, where said antenna element has one feed pin and at least one ground pin, and said at least one ground pin is connected to said ground plane, wherein said feed pin and said at least one ground pin are positioned on the a same side of a slot in said ground plane, said slot extending in a direction different from an extending direction of the antenna element, wherein said ground plane is positioned at a predefined distance from a mounting surface, and wherein said slot is designed to compensate for a capacitive or an inductive connection between said ground plane and an external ground plane on said mounting surface, and wherein the antenna element of the multiband low profile antenna arrangement is in the form of an inverted-F antenna or a planar inverted-F antenna.

2. The antenna arrangement according to claim 1, wherein a total length of said slot is equal to, or longer than, $\lambda_{peak}/8$, where $\lambda_{peak}$ is a wavelength corresponding to a frequency generated by said capacitive or inductive connection between said ground plane and said external ground plane at said predefined distance from said ground plane.

3. The antenna arrangement according to claim 2, wherein said slot is positioned with an angle into said ground plane that allows the total slot length.

4. The antenna arrangement according to claim 2, wherein said slot has a shape that provides the total slot length such as a zig-zag shape.

5. The antenna arrangement according to claim 2, wherein the slot includes two or more slots with a combined total length of at least $\lambda_{peak}/8$, in order to achieve the total slot length of at least $\lambda_{peak}/8$.

* * * * *